US007451986B1

(12) United States Patent
Thrasher

(10) Patent No.: US 7,451,986 B1
(45) Date of Patent: Nov. 18, 2008

(54) INTERACTIVE SPORTING EVENT GAME

(76) Inventor: Scott Thrasher, 959 E. Axton Rd., Bellingham, WA (US) 98226

( * ) Notice: Subject to any disclaimer, the term of this patent is extended or adjusted under 35 U.S.C. 154(b) by 157 days.

(21) Appl. No.: 11/465,882

(22) Filed: Aug. 21, 2006

(51) Int. Cl.
*A63F 3/00* (2006.01)

(52) U.S. Cl. ..... 273/259; 273/298

(58) Field of Classification Search ..... 273/259, 273/274, 292, 298, 244, 277
See application file for complete search history.

(56) References Cited

U.S. PATENT DOCUMENTS 4,252,321 A * 2/1981 Hopwood ..... 273/247
4,429,877 A * 2/1984 Coppock ..... 273/139
4,540,174 A * 9/1985 Coppock ..... 463/17
4,822,043 A * 4/1989 Carter ..... 273/298
4,953,873 A * 9/1990 Jacobson ..... 273/274
5,090,735 A * 2/1992 Meaney et al. ..... 283/67
5,522,590 A * 6/1996 Moran ..... 273/244.2
5,730,443 A * 3/1998 Allen ..... 273/459
5,782,470 A * 7/1998 Langan ..... 273/139
5,884,914 A * 3/1999 Lilien ..... 273/244.1
6,209,872 B1 4/2001 Caswell
6,293,868 B1 * 9/2001 Bernard ..... 463/42
6,338,486 B1 * 1/2002 Hutchens ..... 273/298
6,663,107 B2 12/2003 Fisher et al.
6,783,128 B2 8/2004 Casey et al.
7,334,796 B2 * 2/2008 Wittwer ..... 273/277
2004/0066002 A1 4/2004 Spring

* cited by examiner

*Primary Examiner*—William M Pierce
(74) *Attorney, Agent, or Firm*—Michael F. Hughes; Hughes Law Firm, PLLC

(57) ABSTRACT

A game that involves cards or other point indicating items where players observe a sporting event such as football and if certain actions occur in the sporting event that correlate to a prearranged list, players are awarded cards.

20 Claims, 13 Drawing Sheets

| CARDS RECEIVED | | DESCRIPTION |
|---|---|---|
| | | **Example Offensive Team Actions** |
| 1 | | For a first down, but not a touchdown, add one plus: |
| 1 | if | 25-49 yards-If touchdown add 2 cards plus the extra point |
| 2 | if | 50-74 yards-If touchdown add 2 cards plus the extra point |
| 3 | if | 75-99 yards-If touchdown add 2 cards plus the extra point |
| | | Any return(punt, kickoff, fumble, or interception) |
| 1 | if | 25-49 yards-If touchdown add 2 cards plus the extra point |
| 2 | if | 50-74 yards-If touchdown add 2 cards plus the extra point |
| 3 | if | 75-99 yards-If touchdown add 2 cards plus the extra point |
| 4 | if | 100+yardsIf touchdown add 2 cards plus the extra point |
| 2 | | Blocked punt, field goal, or extra point |
| 1 | | Extra point converted |
| 1 | | Field goal 0-40 yards |
| 2 | | Field goal 41-49 yards |
| 3 | | Field goal 50-54 yards |
| 4 | | Field goal 55-59 yards |
| 5 | | Field goal 60+ yards |
| 1 | | First down from scrimmage |
| 1 | | Holding offense on 4th down |
| 2 | | Touchdown |
| 2 | | Two point conversion |
| | | **Example Defensive Team Actions** |
| 1 | | Missed field goal of 25 yards or less |
| 3 | | Onside kick—recovered |
| 1 | | Punt 50 yards or more |
| | | (if downed inside the 5 yard line add one card) |
| 1 | | Punt or Kickoff downed inside the 5 yard line |
| 1 | | Quarterback Sack |
| 5 | | Safety—If from blocked punt add two cards |
| 1 | | Fumble recovered by defense or interception |
| | | (players representing the offense submit a card to deck) |

| CARDS RECEIVED | | DESCRIPTION |
|---|---|---|
| | **Example Offensive Team Actions** | |
| 1 | | For a first down, but not a touchdown, add one plus: |
| 1 | if | 25-49 yards-If touchdown add 2 cards plus the extra point |
| 2 | if | 50-74 yards-If touchdown add 2 cards plus the extra point |
| 3 | if | 75-99 yards-If touchdown add 2 cards plus the extra point |
| | | Any return(punt, kickoff, fumble, or interception) |
| 1 | if | 25-49 yards-If touchdown add 2 cards plus the extra point |
| 2 | if | 50-74 yards-If touchdown add 2 cards plus the extra point |
| 3 | if | 75-99 yards-If touchdown add 2 cards plus the extra point |
| 4 | if | 100+yardsIf touchdown add 2 cards plus the extra point |
| 2 | | Blocked punt, field goal, or extra point |
| 1 | | Extra point converted |
| 1 | | Field goal 0-40 yards |
| 2 | | Field goal 41-49 yards |
| 3 | | Field goal 50-54 yards |
| 4 | | Field goal 55-59 yards |
| 5 | | Field goal 60+ yards |
| 1 | | First down from scrimmage |
| 1 | | Holding offense on 4th down |
| 2 | | Touchdown |
| 2 | | Two point conversion |
| | **Example Defensive Team Actions** | |
| 1 | | Missed field goal of 25 yards or less |
| 3 | | Onside kick—recovered |
| 1 | | Punt 50 yards or more |
| | | (if downed inside the 5 yard line add one card) |
| 1 | | Punt or Kickoff downed inside the 5 yard line |
| 1 | | Quarterback Sack |
| 5 | | Safety—If from blocked punt add two cards |
| 1 | | Fumble recovered by defense or interception |
| | | (players representing the offense submit a card to deck) |

FIG. 3

Golf game distribution list

| | |
|---|---|
| birdie | two cards |
| eagle | three cards |
| bogey | lose one |
| double bogey | lose two |
| worse than double | lose three |
| par | one card |
| fairway hit | one card |
| green in regulation | one card |

FIG. 6

ARENA FOOTBALL CARD DISTRIBUTION

| CARDS RECEIVED | | DESCRIPTION |
|---|---|---|
| | | Any run or pass from scrimmage: |
| | | For a first down, but not a touchdown, add one plus, |
| 1 | if | 20 - 34 yards-If touchdown add 2 cards plus the extra point |
| 2 | if | 35 - 50 yards-If touchdown add 2 cards plus the extra point |
| | | Any return (punt, kickoff, fumble, or interception) |
| 1 | | 20 - 34 yards-If touchdown add 2 cards plus the extra point |
| 2 | | 35 - 50 yards-If touchdown add 2 cards plus the extra point |
| 2 | | Blocked Punt, Field Goal, or Extra Point |
| 1 | | Extra point converted |
| 1 | | Field Goal 0 - 20 yards |
| 2 | | Field Goal 21 - 29 yards |
| 3 | | Field Goal 30 - 39 yards |
| 4 | | Field Goal 40 - 49 yards |
| 5 | | Field Goal 50 yards or more |
| 1 | | First down from scrimmage |
| 1 | | Holding offense on 4th down |
| 1 | | Missed field goal of 20 yards or less |
| 3 | | Onside kick - recovered |
| 1 | | Punt 40 yards or more (if downed inside the 5 add one card) Punt 40 yards or more (if downed inside the 5 add one card) |
| 1 | | Punt or Kickoff downed inside the 5 yard line |
| 1 | | Quarterback Sack |
| 5 | | Safety - If from blocked punt add two cards |
| 2 | | Touchdown |
| 2 | | Two point conversion |

If a fumble or an interception occurs, the defensive team recovering the ball will receive one card from the deck. However, the offensive team will lose a card by mixing up their hand and holding them face down while another person draws one card. This card will be returned to the back of the deck.

FIG. 7

CFL CARD DISTRIBUTION

| CARDS RECEIVED | | DESCRIPTION |
|---|---|---|
| | | Any run or pass from scrimmage: |
| | | For a first down, but not a touchdown, add one plus, |
| 1 | if | 25 - 49 yards-If touchdown add 2 cards plus the extra point |
| 2 | if | 50 - 74 yards-If touchdown add 2 cards plus the extra point |
| 3 | if | 75 - 99 yards-If touchdown add 2 cards plus the extra point |
| 4 | if | 100+ yards-If touchdown add 2 cards plus the extra point |
| | | Any return (punt, kickoff, fumble, or interception) |
| 1 | | 25 - 49 yards-If touchdown add 2 cards plus the extra point |
| 2 | | 50 - 74 yards-If touchdown add 2 cards plus the extra point |
| 3 | | 75 - 99 yards-If touchdown add 2 cards plus the extra point |
| 4 | | 100+ yards-If touchdown add 2 cards plus the extra point |
| 2 | | Blocked Punt, Field Goal, or Extra Point |
| 1 | | Extra point converted |
| 1 | | Rouge |
| 1 | | Field Goal 0 - 40 yards |
| 2 | | Field Goal 41 - 49 yards |
| 3 | | Field Goal 50 - 54 yards |
| 4 | | Field Goal 55 - 59 yards |
| 5 | | Field Goal 60 yards or more |
| 1 | | First down from scrimmage |
| 1 | | Holding offense on 4th down |
| 1 | | Missed field goal of 25 yards or less |
| 3 | | Onside kick - recovered |
| 1 | | Punt 50 yards or more (if downed inside the 5 add one card) |
| 1 | | Punt or Kickoff downed inside the 5 yard line |
| 1 | | Quarterback Sack |
| 5 | | Safety - If from blocked punt add two cards |
| 2 | | Touchdown |
| 2 | | Two point conversion |

If a fumble or an interception occurs, the defensive team recovering the ball will receive one card from the deck. However, the offensive team will lose a card by mixing up their hand and holding them face down while another person draws one card. This card will be returned to the back of the deck.

FIG. 8

Rugby Card Distribution

| Action | Result |
|---|---|
| Try | 5 cards |
| Conversion | 2 cards |
| Penalty kick | 3 cards |
| Drop goal kick | 3 cards |

FIG. 9

Baseball Card Distribution List

Offense

| | |
|---|---|
| Single | 1 card |
| Double | 2 cards |
| Triple | 3 cards |
| Homerun | 4 cards |
| Run scored | 1 per run scored |
| Stolen base | 1 card |
| Hit by pitch | 1 card |
| Walk | 1 card |

Defense

| | |
|---|---|
| out | 1 card |
| double play | 2 cards plus one extra card |
| triple play | 3 cards plus two extra cards |
| strikeout | 1 card plus one extra card |

Combine where necessary
Offense is dealt first

FIG. 10

Bowling Card Distribution

| Action | Result |
|---|---|
| Strike | 1 card |
| 2 strikes or more in a row | 2 cards |
| Spare or split conversion | 1 card |
| Open Frame | lose 1 card |

FIG. 11

Soccer Card Distribution

| Action | Result |
|---|---|
| A foul occurs on the attacking half of field | 1 card for team fouled |
| Yellow Card | 1 card for team fouled |
| **If yellow card comes from a fake flop | +1 card |
| Red Card | 2 cards for team fouled |
| Corner kick | 2 cards for offensive team |
| Goal | 5 cards for offensive team |
| **If goal is from shot off of head | +1 card |
| **If goal is a direct kick outside of the 18 box | +2 cards |
| If goalie stops a shot on goal | 2 cards for defensive team |

Combine where necessary

FIG. 12

INTERACTIVE SPORTING EVENT GAME

BACKGROUND

In general, the disclosure is a game, in particular a card game which is adapted to be used interactively while observing a sporting event. The sporting event may be observed live, on a television, radio, data transmission online, video, DVD, or by any other media.

Card games, including games that are based on a sports theme are well known in the art. These games are known to simulate sporting events, or to rely on a player's knowledge of the sporting event to succeed in play. A cursory search of prior art examples included: U.S. Pat. No. 5,730,443 which is not a card game, and requires a thorough knowledge of the sporting event football to play; U.S. Pat. No. 6,783,128 which involves a particular type of scoring in live observance of the sporting event of baseball and requires a knowledge of baseball to determine the outcome of an action and uses unique cards corresponding to unique events occurring during a baseball sporting event and furthermore requires that players "guess" the outcome of a player at bat prior to the pitch, then play a corresponding card; patent application 2004/0066002 which involves a particular type of scoring, simulates a football game and does not include observing a sporting event while playing; U.S. Pat. No. 6,663,107 uses unique cards corresponding to unique events occurring during a sporting event and requires that players "guess" the outcome of an event prior to the event taking place, and playing a corresponding card; U.S. Pat. No. 6,338,486 uses unique cards corresponding to unique events occurring during a sporting event; U.S. Pat. No. 6,209,872 is a board game where the object is to move your piece around the playing surface before your opponents.

In general the prior art devices require more knowledge and foresight of the players and the individuals in the upcoming situation. The rules described herein set forth knowledge of the game which predicates the distribution of cards and having a successful winning hand.

SUMMARY OF THE DISCLOSURE

The disclosure herein describes a game, in particular a card game which is adapted to be used interactively while watching or listening to a sporting event, say for example football. It may also be possible to observe the sporting events by other media, such as a golf tournament observed via a newspaper or online scoreboard technology. The gist of the game is that when certain events in a sporting event occur, players receive cards (or lose cards), or points. Cards may have a designated numeric value associated therewith, and at the end of the game the player with the highest value (the sum of the value of all of the cards in their possession) or poker hand is the winner. In the event of a tie at the end of a round, the winning player of the round will be determined by a roll of dice, rock paper scissors, flip a coin, draw cards from a deck, or some other agreed upon method.

One aspect of this disclosure is that it does not require any understanding of the sporting event being viewed to play the card game. A player having no prior understanding of the rules or play of the sporting event could enjoy playing this card game, and could succeed in winning against another player who fully understands the rules and play of the sporting event. One example of drawing people into being a more interactive-type action, say for example one of the listed actions such as a punting. This of course draws people in when say there is a change of possession and what may seemingly be a boring play such as a punt becomes much more interesting, because people will view the play very close, the distance where for example a 50 yard punt is a listed action, which is rewarded by receiving cards. Therefore, certain people may watch very closely to count the yards from one side to the other from where the punt was to determine if it met this criteria.

This game could be played without player involvement. Once the event begins, possible distribution occurs, based on actions within the observed event. Such as where one person is designated to follow the sporting event and distribute cards.

If a player is not very knowledgeable about a sport such as football, they would be much more inclined to be inquisitive as to what events may be an actionable card distribution event. It should further be noted that because the quantitative measures such as knowing how many yards will require points, this breeds extra attentiveness to the situation of the actual field position, and actually brings in some mathematical skills to determine the gains on each play if they are not announced. In another variation, if certain events occur such as penalties, instead of card distribution other actionable events could occur, such as consuming a beverage. It is conceivable that the game would be played with a beverage being consumed instead of points or cards being awarded.

BRIEF DESCRIPTION OF THE DRAWINGS

FIG. 3 is a possible list of actions occurring during a field football event;

FIG. 6 is a possible list of actions occurring during a golf event;

FIG. 7 is a possible list of actions occurring during an arena football event;

FIG. 8 is a possible list of actions occurring during a CFL event;

FIG. 9 is a possible list of actions occurring during a rugby event;

FIG. 10 is a possible list of actions occurring during a baseball event.

FIG. 11 is a possible list of actions occurring during a bowling event.

FIG. 12 is a possible list of actions occurring during a soccer event.

DESCRIPTION OF THE PREFERRED EMBODIMENTS

In the disclosure below there will first be a general description of the basic play of the card game. Thereafter there will be a more detailed discussion of the method of playing the game including their various derivatives from the basic rules of play.

Figure 1:
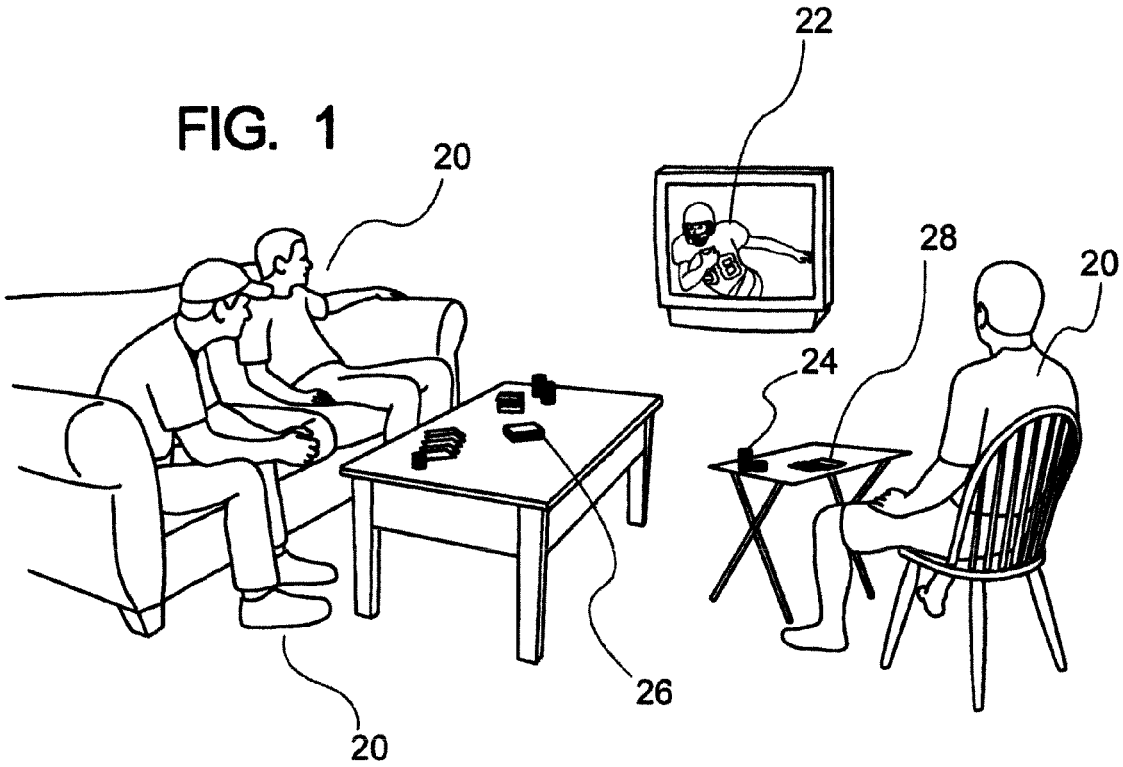
FIG. 1 is an environmental view of players observing a sporting event and playing the card game described herein.
Figure 2:
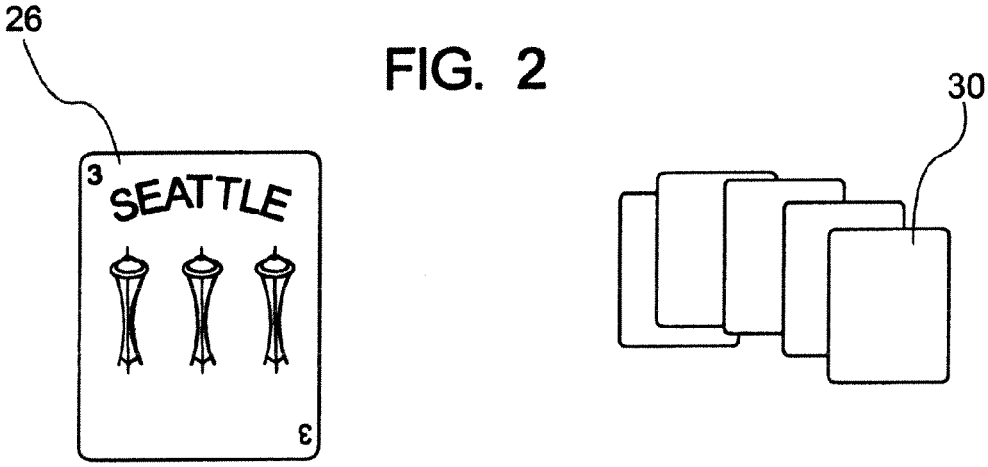
FIG. 2 is a schematic view of the cards of an embodiment.

A round begins with each player selecting a team or representative to represent their interest in the card game. Referring now to FIG. 1, there is a schematic environmental view of various players 20 watching a sporting event 22. For example, the sporting event 22 could be a football game. Now referring to FIG. 2, when a certain event occurs such as that shown in the partial list in FIG. 3, a player may receive a card 26 from the deck 30. For example, if a player 20 has selected the team that is on defense when a sack occurs, then that player 20 may receive a card 26 from the deck 30. Alternatively, if a first down occurs then players 20 that selected the team on offense each may receive a card 26 from the deck 30. Further, a touchdown may count for two cards and the extra point for a third card so the players 20 which selected the team on offense could receive three cards 26 from the deck 30. As an additional component of the game, when a player 20 draws an "interception card" 50 they may choose any player 20 to take a card 26 from. The player 20 submitting a card 26 at this point shuffles their hand 28 and then the player with the "interception card" 50 randomly (not knowing the value) draws one of their cards 26 and adds it to their hand 28. A "fumble card" 52 is played in a similar manner. If a player were to receive a "fumble card" 52, then that player may turn his cards 28 face down, shuffle them, and a card may be randomly selected by any other player 20 and returned to the deck 30.

Another embodiment can include a "sudden-death card" 54 where the player 20 drawing this card 54 will tie the player with the highest point total at that the end of the round.

The numeric values for each card can correspond to the points that are acquired in the sporting event where, for example, the numeric value for each of the cards 26 in the deck 30 can be one of 1, 2, 3, 6, or 7 if the sporting event observed is football. Each player 20 has an assortment of cards 28 which may be shown face up to all the other players so every player knows every other player's present score. A player's score may be the sum of the face value of the cards 26 in the player's possession 28, the best poker hand, the total points of similar cards or any other scoring system.

There will now be a more detailed discussion one form of carrying out the card game. For the sake of consistency, the same reference numeral will be used to denote the same element in all the figures and in the disclosure. Furthermore, in order to avoid needlessly cluttering the drawings, certain elements have been purposely omitted. Some of these elements not shown are mentioned in the description or completely omitted if they are only of a very secondary nature with respect to the invention.

Watching a football game for example, is a particularly conducive environment for the card game to be played. Football has brief pauses whereby an evaluation can occur as to whether a listed action such as that shown in FIG. 3 was accomplished whereby a player 20 would receive cards 26 from the deck 30 in a manner as prescribed below.

In this disclosure, an action is a play that occurs during a sporting event 22. Such actions include but are not limited to: a first down in football, sacking the quarterback in football, 25 yard run in football, a homerun in baseball, strike out in baseball, 3 point score in basketball, birdie in golf, etc. FIG. 3 shows a possible list of actions conforming to a football game. FIGS. 6-10 show alternate lists of actions corresponding to golf, arena football, CFL football, rugby, and baseball.

As shown in FIG. 1, a round begins with each player 20 or group of players selecting a team to represent. Henceforth the term "player" will be used whether persons are playing individually or in groups. Once the round begins, cards 26 will be received or submitted based on predetermined criteria. If a player 20 is to receive or submit a card, and multiple individuals 20 have selected the same team, then each player 20 will receive or submit the required number of cards 26.

Figure 4:
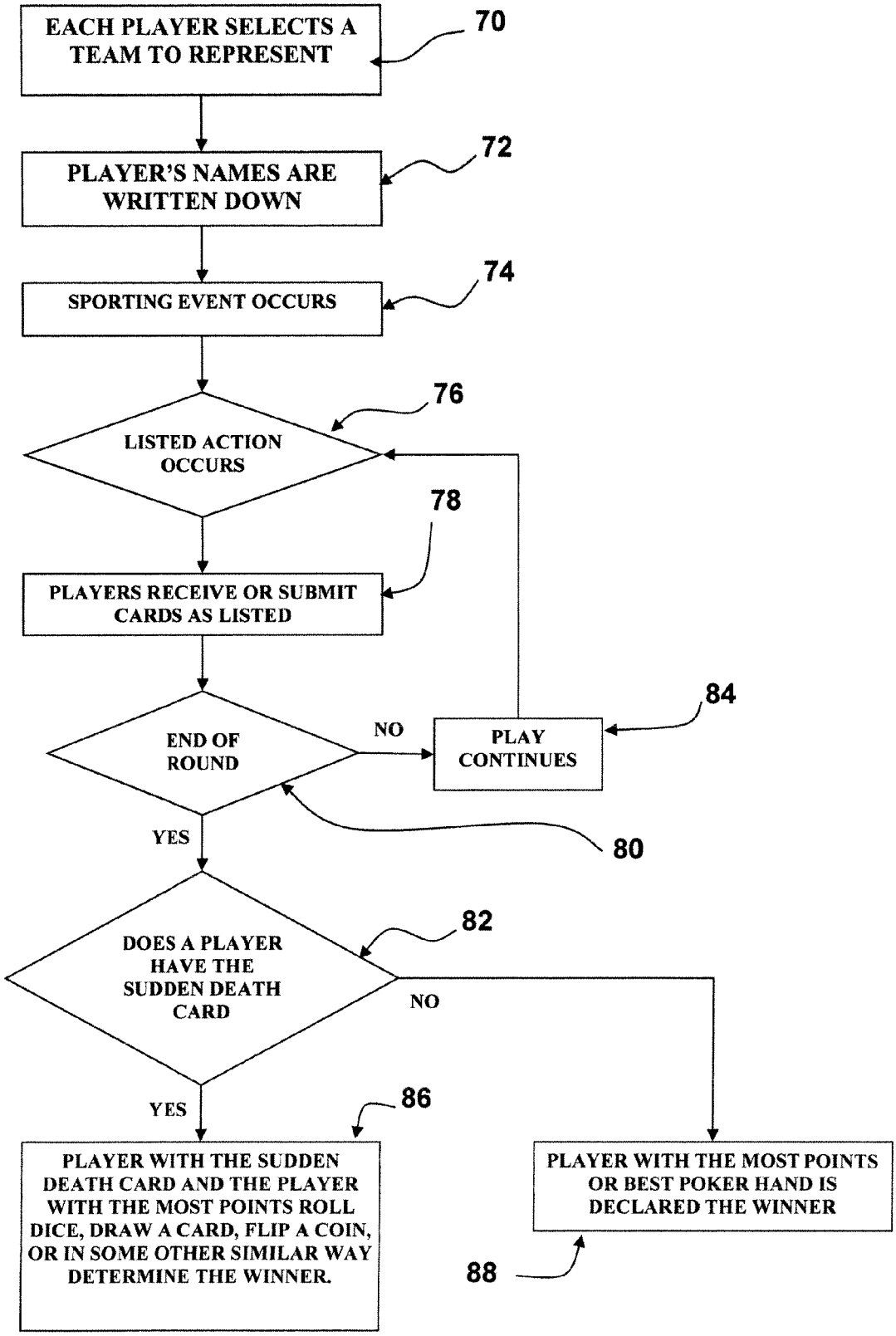
FIG. 4 is a simple flowchart of the game.

Now referring to FIG. 4, there will be a more detailed description of the play of the game with reference to the flowchart. In general, as shown in step 70, before the sporting event has begun (or it could be anytime during the sporting event when the players decide to commence playing the card game), each player selects a team to represent their interests in the game. The players could select either their favorite team or the team they believe will perform better in the sporting event and achieve a greater number of actions such as those that are laid out in FIG. 3.

In an optional form, the players' names are written down as step 72, which is not necessary but can be utilized for helping to keep score and determine a concise order of distribution as the number of hands is played out.

Now referring to step 74, the sporting event commences, and the individuals playing the game either passively or actively observe the sporting event and compare every action that occurs in the sporting event to the actions prescribed in the action list (such as that shown in FIG. 3) to see if a listed action has occurred as shown in step 76 to see if they have any cards forthcoming step 78. Of course, play can commence at any time, and if the players decide to, begin the game after the sporting event occurs, they could commence at that time. Of course, provisions can be made if players come in late in the game that they are dealt, for example, a low number of cards held by any lowest player currently playing, so they can "get up to speed." For example, if three players 20 are playing and two players 20 have four and five cards in their hand, and one player has three cards in their hand, the fourth additional player would get, for example, three cards to begin play. Of course, the rules could be modified for the median number of players, or even the maximum number.

If one or more of the predetermined terminating events has occurred, then we move from step 80 to step 82 to see if any player has a "sudden death joker" (or overtime) card. If none of the terminating events has occurred, then play continues step 84 and the players watch the sporting event for another listed event. If a player does have the "sudden death joker card" then as shown in step 86 the player with the card and the player with the most points determine between themselves the winner, or split the accumulated res or "ante". If no player has the "sudden death joker card" then the player with the most points or the best poker hand is declared the winner as shown in step 88. If the sporting event has not concluded, then the cards are shuffled and a new round commences as shown in step 90.

Figure 5:
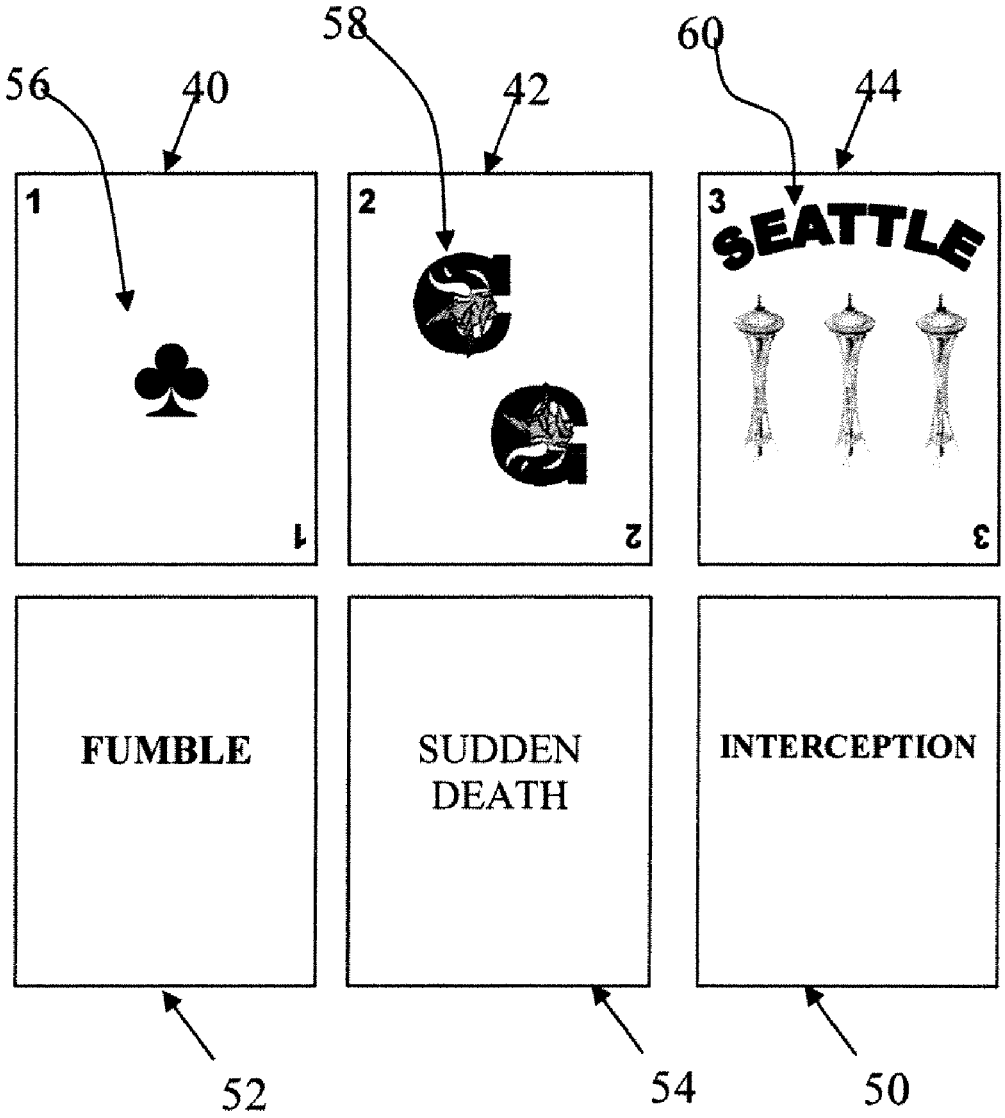
FIG. 5 shows several possible cards comprising the card deck.

In one embodiment, the cards 26 have a common back side to make them indistinguishable while face down. The alternate, or face side would have numbers 62 printed on them and possibly a suit 56. Several variations are shown in FIG. 5. The suit 56 could be depicted by cities 60, team names, team mascots 58, animals, or the traditional hearts, clubs 56, spades and diamonds, etc.

The sporting event 22 being observed used as an example is a football game between team A and team B. Player A will be the player or players who selected team A, and Player B will be the player or players who selected team B.

When an action in the football game benefits team A, and that action is on the list of predetermined criteria FIG. 3 and FIGS. 6-10, the player 20 who selected team A at the outset may receive at least one card 26 from the deck 30. For example, if team A makes a first down, then player A may receive a card from the deck 30. If team A also advances 25 to 49 yards in that play, then player A may receive an additional card 26. By looking at the number of additional cards received on the list represented in FIG. 3, this can be easily understood. Unless otherwise arranged, all cards 26 could be drawn from the deck 30.

If player A were to receive an "intercept card" 50, "fumble card" 52, or "sudden death joker card" 54, then there may be further considerations before play can continue which will be described in more detail.

If player A were to receive an "intercept card" 50, then player A may choose one card 26 from any player 20. In this case the other player might turn their cards 28 face down, shuffle them, and player A can randomly select a card 26 from these cards 28. Player A can then keep both the "intercept card" 50 and the selected card.

If player A were to receive a "fumble card" 52, then player A may turn his cards 28 face down, shuffle them, and a card may be randomly selected by any player 20 and returned to the deck 30.

If for example player A were to receive a "sudden death joker card" 54, then player A may receive points to tie the player with the most points, at the end of the round. For example if player A has 30 points and the "sudden death joker card" 54, and at the end of the hand player B has 50 points and has more points than any other player, then player A could receive 20 points and tie player B. This is described in more detail below. While the term "sudden death joker" is used throughout this disclosure, other terms may be used to identify a card with this function.

When team A is on defense, and there is a change in possession, such as an interception or fumble, then a card 26 could be randomly selected from player B and submitted to the deck 30. Player A could receive a card 26 from the deck 30.

It should be noted that an occurrence like an extra point is all part of one play whereby, for example, one player 20 has six cards and a touchdown is scored as well. The cards that are going to be dealt are going to bring this player over seven, but the round continues until the extra point is completed, whereby the round is ended and the cards are counted if having seven cards is a terminating event. If offensive team A goes for two points and is successful, then player A will receive two cards for the touchdown, and two cards for the extra points, plus any additional cards for bonus yards. Should team A kick the extra point, then player A would receive two cards for the touchdown, one for the extra point, plus any cards for bonus yards. If the extra point attempt is not successful, then player A would receive 2 cards for the touchdown in addition to any cards for bonus yards.

A round continues until a terminating event occurs, such as for example; one player has a certain number of cards such as twelve, or every player has at least a certain number of cards, such as seven. A round may also end at a terminating event triggered by the sporting event such as: the end of the first half, the end of a period, or at the end of the sporting event. The player 20 who has the most points, or alternatively, the person with the best poker hand, would be declared the winner.

If a player has the "sudden death joker card" 54, then that player will tie the player with the highest number of points at the end of the round, and the winner of the round could be determined by a roll of dice, rock paper scissors, draw cards from the deck, or some other agreed upon method. It is also possible that two or more players 20 tying for the win would split the combined res 24 amongst themselves.

In another form, as shown in FIG. 1, each player 20 would submit transferable res or "ante" 24, such as a coin, beverage, or other article at the beginning of a round. This ante 24 would be kept until the end of the round. At the end of the round, the winner would come into possession of the assembled antes for that round.

The sporting event may be observed in person, on television, radio, web cast, pod cast, pre-recorded, or possibly viewed in print media such as newspaper. The term observed will be used to cover all possibilities to avoid confusion.

In one embodiment, players 20 will only be able to select a different team to represent at halftime or at the end of a period of play. Another alternative could be to have certain identifiers with value such as poker chips included in the packaging to induce a certain amount of competition. It should be noted that each of the cards may have certain suit thereon, where for example if the points are 1, 2, 3, 6 and 7, or some combination of say 1, 2, 3 and 6. Each one of these subsets may have a different suit, such as a team or city or college or what have you placed thereon. Therefore, at the end of the round, if one player has two or more cards of the same suit, such as those shown in FIG. 5, the matching cards will be summed and the player with this high score at the end of the round would receive his ante 24 back regardless of who won the overall hand. Therefore, referring to FIG. 4, following step 80 in one form, if an individual has won a "side game" such as having matching cards, shown as an example in the upper portion of FIG. 5, then he would receive his side bet back. If an event happens such as an "intercept card" 50 being drawn, the player may take into account not only the number of cards, or values of the cards another player may have, and but also which player has similar team cards as the player who acquired the intercept card.

In a further embodiment, at the end of a round, a player having a pair of cards of the same suit would be eligible to receive his ante 24 back if the sum of the pair of cards were of a higher value than any other player. As in the common card game of poker, three of a kind beats two of a kind; four of a kind beats three of a kind etc.

FIGS. 6-12 show a possible list of actions for other sporting events. For example, in a game such as golf there is a sufficient amount of time to allow for distributing cards and determining whether an action which occurred in the golf game corresponds to a listed event such as shown in FIG. 6.

FIGS. 7 and 8 show a slightly modified list for other types of football other than the National Football League rules and collegiate rules. For example, FIG. 7 shows a type of card game for arena football where there is a sample set of types of events under the description column, and the corresponding cards received for such an event occurring as an actual action within the competition. FIG. 8 shows a similar set of possible events for the Canadian Football League. Of course, the various event lists can be altered, but the various figures illustrate one possible type of method for carrying out the invention which is broadly claimed below.

FIG. 9 shows a possible action list for a rugby game. Of course rugby has fewer intermissions between an event than a football game would. However, present analysis indicates that the type of game described above can be utilized for rugby, which may have particular benefits to increasing the spectator base by having spectators less knowledgeable to the rules of rugby be more involved in observing the match to see if any actionable event occurs where participants in the card game are rewarded with cards.

Finally, another example is shown in FIG. 10 where a baseball game list of events is shown. Of course it should be noted that the number of cards as well as the actual events could substantially change; however, the disclosure above provides a basic teaching of the general concept of the method of playing the game.

Referring to FIG. 11, there is shown yet another set of possible events which can occur in, for example, a bowling competition. For example, in a competition such as bowling when individuals pick a certain team, cards would be awarded according to the actions occurring within this competition. If the bowler has a particularly good throw that results in a strike, of course the players who chose that individual competitor or team is awarded cards. Now referring to FIG. 12, there is shown yet another variation of the game for soccer. Again, as stated above, various example actions are shown but of course the final action list can vary. It should be noted in a game such as soccer where less notable actions occur than would perhaps occur in a football game, more cards can be distributed for certain types of actions. For example, goals are quite rare in soccer and the scores tend to be rather low. Therefore, a goal might be worth five or more cards. Of course, the number of cards in any final embodiment can vary.

Figure 13:
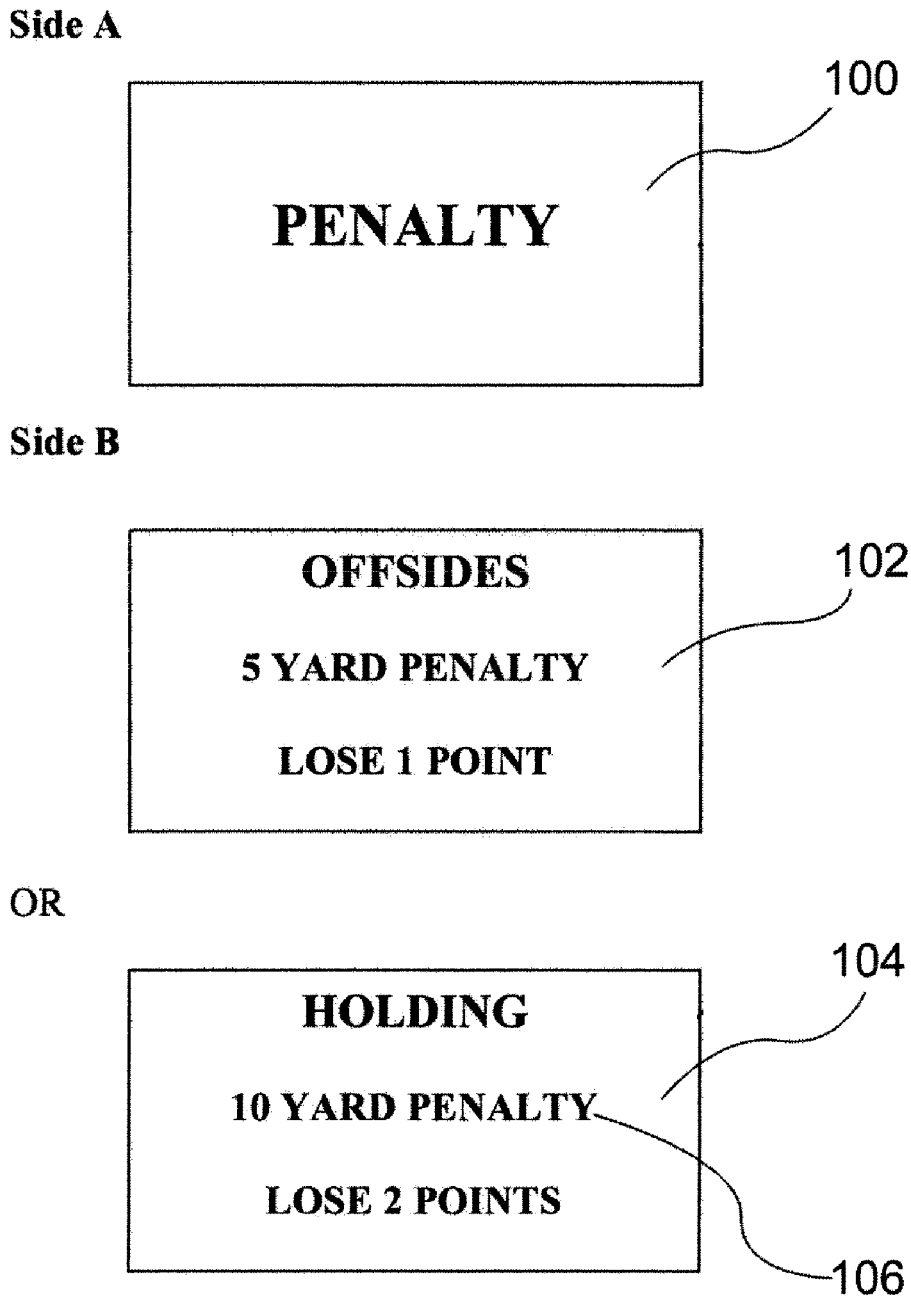
FIG. 13 shows a modification of one form of the game where a sample penalty deck is shown.

Now referring to FIG. 13, there is shown another derivative of the game where a separate deck can be utilized as a "penalty deck." As shown in the upper portion of FIG. 13, the deck 100 can include an additional plurality of cards. In one form, the deck can be a different color such as yellow with respect to the other deck 30 as shown in FIG. 1. The deck 100 is reserved for situations where a penalty event occurs. In one form, a penalty event is an actual penalty within the sporting competition, such as a yellow flag in a football game. Whenever a team incurs any form of a penalty, the individuals that have chosen that team as their representation would each get a penalty card. As shown in the lower portion of FIG. 13 at 102 and 104, there are two examples of possible inscriptions for the penalty card. For example, as shown in 102, the individuals would actually lose one point if they drew this card and the point would be subtracted from their total score at the end of the game. The inscription 104 shows another example where two points would be lost, and the region 106 indicates some form of random action that corresponds to the sporting event to indicate the rationale for the lost number of points. Of course, the amount of points in the written material do not necessarily correlate with the actual occurrence in the sporting event, but can generally relate to types of penalties which occur in such a sporting event.

In one form, the penalty card is not included in the card count for terminating a hand. For example, as described above in detail, a certain number of cards from the deck 30 is utilized to determine what hand has terminated. However, in one form, the penalty deck is not included in the total number of cards. In other forms it can be included, depending on the choice of the method of play. In another form, a penalty event can be separate or in addition to an actual penalty within a sporting event where, for example, in a prearranged manner, certain actions by the individuals 20 (as shown in FIG. 1) participating in the game undergo certain actions which warrant a penalty. Such pre-defined actions could be, for example, swearing, spilling a beverage, mentioning a certain subject or individual, talking loudly or shouting, which is deemed by one referee playing the game or watching the sporting event or otherwise in close proximity to the group of individuals or by way of a vote if one player is unruly. There may be any number of types of criteria which are described in the rules of the game as given or elected by the individuals 20 participating in the game.

Figure 14:
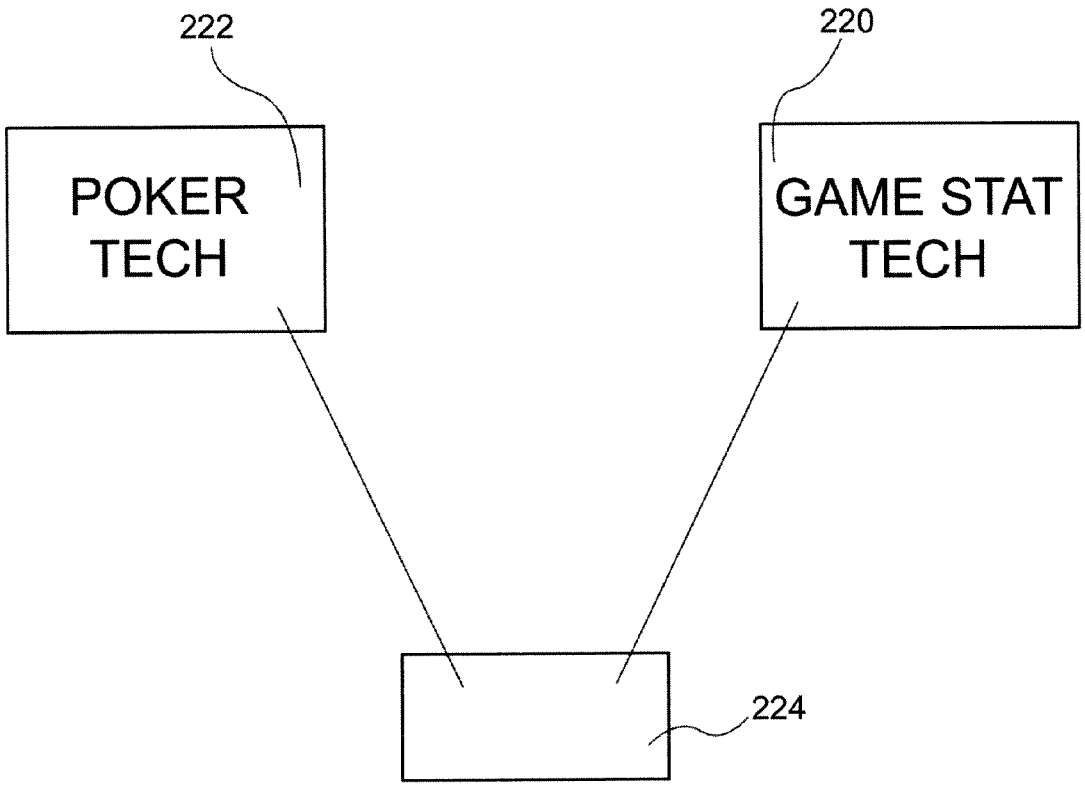
FIG. 14 shows a schematic variation of the game having an online implementation.

As shown in FIG. 14, there is another embodiment where the game stat tech 220 provides all of the technical data occurring due to the actions within a game. These actions are cross-referenced at the poker tech module 222 to determine if an actual event occurs where cards would be distributed. Of course, these abstract objects 220 and 222 can be software modules existing on the internet or any type of electronic device or network. The merger of the game stat tech 220 and the poker tech module 222 can be distributed through any kind of interface 224, which could be one's personal computer or the like. In this form, the interface 224 can actually tell the individuals the number of physical cards to draw, or have a software module to draw and display cards to the various individuals choosing the time representative teams for which the actions have occurred in and correlate to the action list.

It should be noted that the term point value is broadly interpreted to include numeric values as well as other types of values such as poker card values or any other type of system or quantitative process for determining some form of quantitative value. The various types of poker hands that can be played during the game could include all different types such as the regular five card type hands, seven card stud, other variations where community cards are drawn at the very beginning, and people view these cars to determine the hand. Or alternatively, the community cards are drawn at the very end or are some other time during the course of the game. Regarding the poker hand embodiment, one possible method of play is to continue playing until all members playing the game have a certain number of cards. So, for example, the hand is terminated when all players at least have five cards. The individuals having more than five cars can choose from their allotted number to get the best five-card poker hand out of the total number of cards they possess. For example, if one player has collected seven cards, he would arrange the best hand out of the seven cards to make a five-card poker hand.

It should be noted that the term "team" as used herein can be hereby defined as including a normal type of scoring event team as well as an individual participating in the sporting event. It should further be noted that when points are being added or subtracted two a player's score, this includes variations such as adding playing cards (such as poker cards) or the like to a hand, which of course does not necessarily have a finalized determined value until the hand or the game is completed.

A terminating event can include the numerous different types of events such as receiving a number of cards, halftime, or the end of the sporting event or other prearranged occurrences, such as finishing a pitcher of beer.

Of course, this game can be played in mediums other than physical playing cards, for example electronic media such as a plurality of handheld electronic devices (such as PDAs) in communication with one another could distribute the cards to each individual in a similar manner as the physical cards described above.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicant's general concept.

I claim:

1. A method for playing a game having a beginning and an end utilizing a plurality of cards and players, the method comprising the steps of:

a. each player selecting a representative team in a sporting event, b. providing a list of actions that could occur in the sporting event, c. observing the sporting event having a series of specific actions, d. determining when one or more of the specific actions in the sporting event occurs and is listed in the list of actions during the sporting event, e. players receiving or submitting cards according to the list of actions, f. points being added or subtracted to a player's score, g. a terminating event occurring in the game, and h. a winning player being determined.

2. The method of claim 1 wherein the sporting event is observed by means selected from the group consisting of: a television, radio, computer, hand held electrical device, newspaper, and the internet.

3. The method of claim 1 wherein the points being added or subtracted to the player's score are printed on the cards.

4. The method of claim 1 wherein the winning player is determined as the player with the most points at the end of a game or plurality of games.

5. The method of claim 1 wherein the game ends when a terminating event occurs from the group consisting of: a player has a predetermined number of cards, each player has a predetermined number of cards, at halftime of the sporting event being observed, the end of a playing period of the sporting event being observed, or at the conclusion of the sporting event being observed.

6. The method of claim 1 wherein the sporting event is selected from the group consisting of football, baseball, basketball, golf, arena football, rugby, and soccer.

7. The method of claim 1 wherein the plurality of cards include an interception card wherein when a first player is provided an interception card, the first player selects one or more cards from a second player, points are subtracted from the second player losing one or more cards corresponding to a number printed on the card(s) selected, and selected cards are returned to a deck.

8. The method of claim 1 wherein if a first player is randomly provided a "sudden death joker" card, and points are added at the end of the game or plurality of games to the first players accumulated points to bring the first players accumulated points equal to a second players score having the highest accumulated points.

9. The method of claim 1 wherein each player submits a transferable res at the beginning of a game or plurality of games, and the winner at the end of a game or plurality of game wins the submitted res from each player.

10. The method of claim 9 wherein the winner at the end of a game or plurality of games will come into possession of each res from each player.

11. A card game comprising:

a. a plurality of cards each having a point value, b. an event list having events listed therein corresponding to possible actions that can occur during a sporting event, and c. a protocol for acquiring and/or losing cards when an action occurs in the sporting event that corresponds to one of the events included in the event list.

12. The card game of claim 11 further comprising cards with specific actions to be taken when received.

13. The card game of claim 12 wherein the specific action cards include:

a. a "sudden death joker card", b. a "fumble card", and c. an "intercept card".

14. A method for playing a card game comprising a plurality of card while observing a sporting event having various actions occurring in the course of the sporting event which are observed by players observing the sporting event and participating in the card game, the method of playing the card game comprising:

a. players choosing representatives participating in the sporting event whereby actions by each particular representative during the sporting event gives cause to receiving plurality of cards, b. players observing the sporting event and cross-referencing actions that are occurring in the sporting event with a predefined event list, c. determining if an action from the sporting event meets the criteria set out in the event list, d. when an action in the sporting event meets the criteria in the event list, correlating a number of cards identified with the particular action and dealing the cards to the player that chose the representative that executed the particular action, e. terminating a game or plurality of games when either a player or players have accumulated a certain predetermined number of cards or a terminating event has occurred in the sporting event.

15. A method of playing a game utilizing a plurality of cards, each card having a value associated therewith, the method comprising the steps of:

a. players participating in the game choosing a representative, b. observing a sporting event having actions occurring during the sporting event, c. observing an occurring action in the sporting event and comparing the occurring action with an event list comprising a plurality of occurring actions possible in the sporting event, d. if the occurred action is identified on the event list, identifying a numeric number of cards to be dealt that is identified with said occurring action on the event list, e. distributing a number of cards identified with the occurring action to the player that selected the representative that accomplished the action.

16. The method of playing a game as recited in claim 15 where the plurality of cards have numeric values associated therewith and when a player has a prearranged number of cards, a game is completed and the player with the highest sum of the numeric values of the cards in their possession is deemed a winner.

17. The method of playing a game as recited in claim 15 where the plurality of cards have poker values associated therewith and at a prearranged criteria to end the game, the player with the highest poker hand is deemed the winner.

18. The method as recited in claim 15 whereby one of the cards to can comprise a "fumble card" where a first player places this card in their accumulated cards and one of the cards from the hand is returned to a receiving location.

19. The method as recited in claim 15 the plurality of cards comprise an "interception card" whereby if a first player receives the "interception card", the first player would select a card from a second player participating in the game.

20. The method as recited in claim 19 where the first player who receives the "interception card" chooses from the second player randomly.

* * * * *